US006029938A

United States Patent [19]

Fava

[11] Patent Number: 6,029,938

[45] Date of Patent: Feb. 29, 2000

[54] BODY-ATTACHED CUP HOLDER

[76] Inventor: Thomas A. Fava, 2119 Hartford Ave., Johnston, R.I. 02919

[21] Appl. No.: 09/005,485

[22] Filed: Jan. 12, 1998

Related U.S. Application Data

[60] Provisional application No. 60/042,296, Apr. 1, 1997.

[51] Int. Cl.[7] ..... A47K 1/08

[52] U.S. Cl. ..... 248/311.2; 248/231.81; 108/43; 224/222

[58] Field of Search ..... 248/311.2, 315, 248/316.8, 316.7, 227.3, 227.4, 228.7, 230.7, 231.81, 210, 79, 74.2, 74.1, 74.3; 108/104, 43, 42, 44; 215/386; 224/222, 267, 148.4, 148.7

[56] References Cited

U.S. PATENT DOCUMENTS

| | | | |
|---|---|---|---|
| 536,379 | 3/1895 | Gilham et al. | 248/231.81 |
| 2,550,554 | 4/1951 | Griffin | 224/197 |
| 2,785,462 | 3/1957 | Barg | 401/6 |
| 2,969,899 | 1/1961 | Brooks | 224/267 |
| 3,117,759 | 1/1964 | Herer | 248/102 |
| 3,327,391 | 6/1967 | Malm | 433/163 |
| 4,708,273 | 11/1987 | Grant | 224/148.6 |
| 4,739,905 | 4/1988 | Nelson | 222/145.4 |
| 4,878,642 | 11/1989 | Kirby, Jr. | 248/311.2 |
| 4,993,611 | 2/1991 | Longo | 224/148.4 |
| 5,027,992 | 7/1991 | Murray, III | 224/181 |
| 5,056,696 | 10/1991 | Lahr | 224/148.4 |
| 5,169,315 | 12/1992 | Bull | 433/163 |
| 5,176,274 | 1/1993 | Jenkins | 220/17.1 |
| 5,217,294 | 6/1993 | Liston | 362/105 |
| 5,340,006 | 8/1994 | Li | 224/148.4 |
| 5,390,838 | 2/1995 | Jafarkhani | 224/148.4 |
| 5,695,162 | 12/1997 | DiCastro | 248/231.81 |
| 5,732,862 | 3/1998 | Bull | 224/217 |

FOREIGN PATENT DOCUMENTS

| | | | |
|---|---|---|---|
| 756328 | 9/1933 | France | 224/181 |

*Primary Examiner*—Leslie A. Braun
*Assistant Examiner*—Gwendolyn Baxter
*Attorney, Agent, or Firm*—Richard C. Litman

[57] ABSTRACT

A cup holder adapted to be attached to a person's thigh, so that a person's hands may be kept free for other tasks. The cup holder is formed from a material having elastic memory and is comprised of a receptacle member forming a generally cylindrical shell which is open at its top end and closed at its bottom end, and two arcuate arms which extend downwardly therefrom. The receptacle member has a pair of vertical slots formed in the sidewall of the receptacle member running from its top edge to a small distance from its bottom end to allow the receptacle member to flex outwardly to receive a large beverage container and to allow a beverage container having a handle to be placed therein. The arms are formed integrally on the bottom of the receptacle member and they extend downwardly therefrom in spaced relation to each other on opposite sides of the receptacle member so that they may clamp comfortably onto a person's thigh to support the receptacle member vertically thereupon.

3 Claims, 2 Drawing Sheets

BODY-ATTACHED CUP HOLDER

CROSS-REFERENCE TO RELATED APPLICATION

This application claims the benefit of U.S. Provisional Patent Application Serial No. 60/042,296, filed Apr. 1, 1997.

BACKGROUND OF THE INVENTION

1. Field of the Invention

The present invention relates to a container holding device attached to a person's body and, more specifically, to a body-attached cup holder which holds various types of beverage containers and can be attached to a person's thigh.

2. Description of the Related Art

The handling of beverage containers poses significant difficulties to people consuming beverages from them when their hands are needed for other tasks. These difficulties can arise in a number of situations, such as when driving a car or when viewing a sporting event. It is therefore desirable to have a device which enables a person to hold a beverage container without using the hands.

Many devices for enabling a person to hold an object without using one's hands have been disclosed in the relevant art. These have included devices for holding beverage containers which are attachable to a person's body, devices for holding beverage containers which are attachable to a person's clothing, and devices having a means for holding various objects which are attachable to a person's body.

U.S. Pat. No. 3,117,759, issued Jan. 14, 1964 to Jack Herer, discloses a device which is adapted to hold a baby's bottle and attach it to the baby's chest so that the bottle is held in an operative position for the baby's feeding. The bottle-holding device of Herer utilizes a body-encircling base member made of a resilient material to clip the bottle-holding portion of the device to the baby's chest.

U.S. Pat. No. 4,708,273, issued Nov. 24, 1987 to Brian T. Grant, and U.S. Pat. No. 5,056,696, issued Oct. 15, 1991 to Richard Lahr, disclose devices having beverage container receptacles which are adapted to be attached to a person's belt. The beverage container receptacles in both of the above-mentioned patents are formed by a plurality of container encircling bands dispose vertically above the container supporting base. Neither of the above-mentioned devices are adapted to be used by a person in a seated position.

U.S. Pat. No. 4,993,611, issued Feb. 19, 1991 to Rocco Longo, discloses a beverage container holder which is adapted to be attached to a person's neck. The beverage container holder of Longo utilizes a flexible neck-encircling ring attached to a container supporting member which has a serrated hole formed therein for gripping the sides of the container.

U.S. Pat. No. 5,390,838, issued Feb. 21, 1995 to Naser Jafarkhani, discloses another beverage container holder which is adapted to be attached to a person's neck. The beverage container holder of Jafarkhani utilizes a flexible neck-encircling strap attached to a T-shaped support member having a container encircling ring and a container supporting base extending perpendicularly therefrom.

U.S. Pat. No. 2,550,554, issued Apr. 24, 1951 to Bessie Virginia Griffin, discloses yet another neck-attached beverage container holder. The container holder of Griffin utilizes a generally U-shaped member which hooks around a person's neck to support a rigid container holding member in a position extending horizontally from the person's chest.

U.S. Pat. No. 5,340,006, issued Aug. 23, 1994 to Tianhou Li, discloses a head-supported beverage container holder which supports a beverage container in front of a person's mouth so that the beverage therein may easily be consumed through a straw. The beverage container holder of Li includes a serrated container gripping ring that is supported by a pair of support members strapped onto a person's head.

U.S. Pat. No. 4,739,905, issued Apr. 26, 1988 to Steve R. Nelson, discloses a beverage container holder in the form of a hat or helmet having a pair of beverage container receptacles mounted thereon. The beverage container holder of Nelson includes flexible plastic tubing which may be used to connect the beverage containers with a single plastic tube leading to the person's mouth so that the person may easily consume the beverages.

U.S. Pat. No. 5,027,992, issued Jul. 2, 1991 to Edward F. Murray, III, discloses a device adapted to hold various display items and attaches them to the person's body. The device of Murray, III utilizes a generally U-shaped head band made of a resilient material and a stem which attaches to the top thereof to hold the display items above the person's head.

U.S. Pat. No. 2,785,462, issued Mar. 19, 1957 to Joe Barg; U.S. Pat. No. 5,217,294, issued Jun. 8, 1993 to John L. Liston; and French Patent number 756,328 issued Sep. 18, 1933, disclose device for attaching various objects to a person's head. All three of the above devices employ an object-holding member and a head-encircling member.

However, none of the relevant art discloses a beverage container holder adapted to hold various types of beverage containers which has two resilient arms for clamping the beverage container holder onto a person's thigh.

None of the above inventions and patents, taken either single in combination, is seen to describe the instant invention a claimed.

SUMMARY OF THE INVENTION

The invention is a cup holder attached to a person's thigh, so that a person's hands may be kept free for other tasks. The cup holder is formed from a material having elastic memory and comprises a receptacle member and two arcuate arms which extend downwardly therefrom. The receptacle member forms a generally cylindrical shell which is open at its top end and closed at its bottom end to support a cup or other beverage container placed therein. A pair of vertical slots is formed in the sidewall of the receptacle member running from its top edge to a small distance from its bottom end to allow the receptacle member to flex outwardly to receive a large beverage container and to allow a beverage container having a handle to be placed therein. Additionally, the receptacle member may be formed without slots. The arms are formed integrally on the bottom of the receptacle member and they extend downwardly therefrom in spaced relation to each other on opposite sides of the receptacle member. The arms are adapted to clamp comfortably onto a person's thigh to support the receptacle member vertically thereon, but may also be clamped onto any other body parts if deemed useful.

Accordingly, it is a principal object of the invention to provide a beverage container holder which supports a beverage container on a person's thigh.

It is another object of the invention to provide a beverage container holder which is adapted to support several types of beverage containers.

It is a further object of the invention to provide a beverage container holder which is formed entirely of a material having elastic memory so that the arms will flex outwardly to grasp part of a person's body and so that the receptacle member may flex outwardly to receive a large beverage container.

Still another object of the invention is to provide a body-attached beverage container which is adapted to be used by a person in a seated position.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
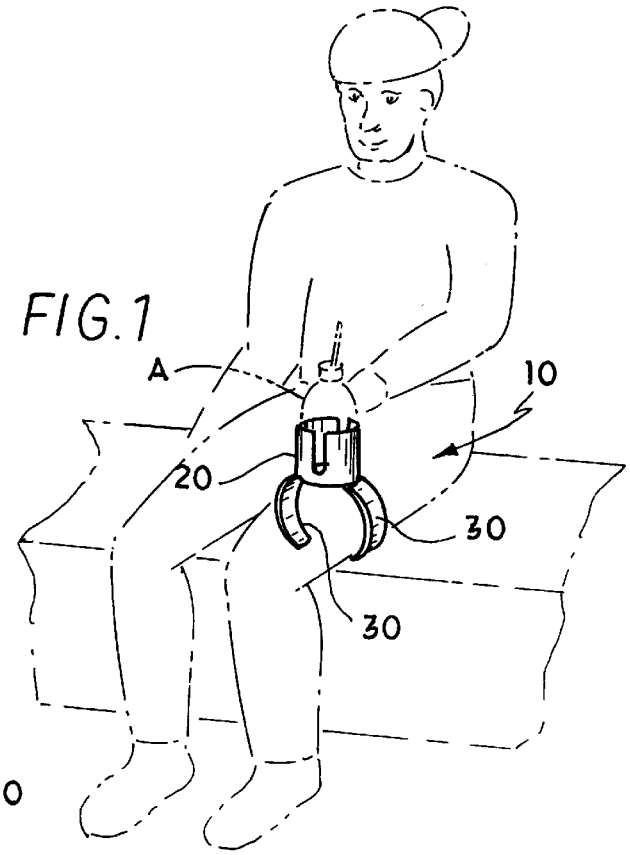
FIG. 1 is an environmental perspective view of the body-attached cup of the present invention in use.

Referring to the drawings wherein like numerals represent like elements, FIG. 1 illustrates the beverage container holder 10 of the present invention which may be attached to a person's thigh or other appropriate body part to support a beverage container A thereon. The beverage container holder 10 generally comprises a receptacle member 20 and a pair of arms 30 formed integrally thereon so that the entire beverage container holder is a one-piece molded structure made from a material having elastic memory.

The receptacle member 20 is defined by a flat circular bottom 24 having a sidewall 22 extending upwardly therefrom around the circumferential edge thereof, so that the receptacle member forms a cylindrical shell having an open top. The inner radius of the receptacle member 20 is large enough to receive the bottom ends of a variety of sizes of beverage containers and the sidewall 22 is high enough to support the sides of the beverage containers to prevent them from tipping over.

Figure 2:
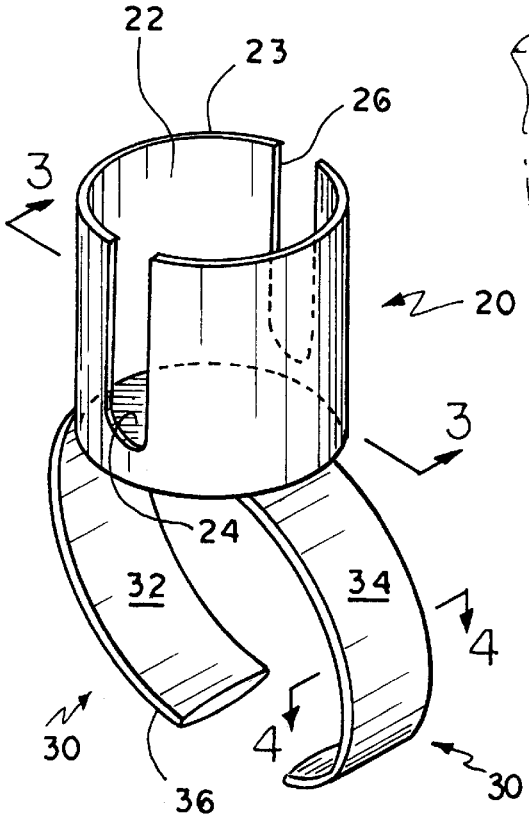
FIG. 2 is an environmental perspective view of the body-attached cup holder of present invention.

A pair of slots 26, best shown in FIG. 2, are formed through the sidewall 22 on opposite sides thereof. Each slot extends vertically downward from the top edge 23 of the sidewall 22 to a small distance above the bottom 24 of the receptacle member 20. The side edges of the slots 26 run parallel and in spaced relation to each other and the bottom edges of the slots 26 form semicircular arches which join the side edges of each slot 26.

The slots 26 formed in the receptacle member 20 in the above described fashion serve to decrease the rigidity of the receptacle member 20 by allowing the halves of the sidewall divided by the slots 26 to flex outwardly. This enables the receptacle member 20 to receive a downwardly tapering beverage container having an outer radius disposed above the bottom of the container that is slightly larger than the inner radius of the receptacle member 20.

The slots 26 formed in the receptacle member 20 also allow a beverage container having a handle extending therefrom to be placed in the receptacle member 20. This is because the side edges of the slots 26 are spaced far enough apart to receive a beverage container handle therethrough. Additionally, the receptacle member 20 may be formed without slots 26 in alternative embodiments.

Figure 3:
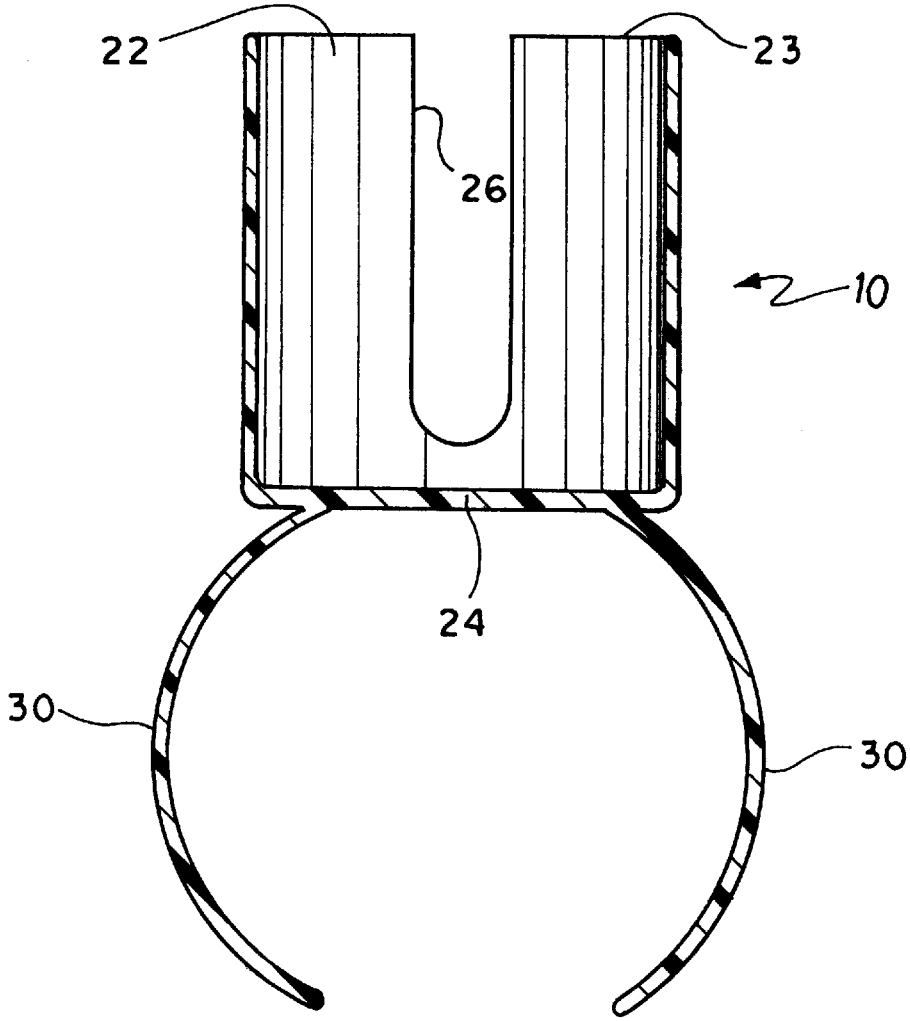
FIG. 3 is a cross-sectional view of the body-attached cup holder of the present invention taken along lines 3—3 of FIG. 2.

The pair of arms 30 is formed on the bottom 24 of the receptacle member 20, each arm being positioned on an opposite side of the receptacle member and adjacent the circumferential edge thereof. Each arm 30 is an arcuate band defined by a concave inner surface 32, a convex outer surface 34, and a side edge 36. The top of each arm 30 is joined integrally with the bottom 24 of the receptacle member 20 and the inner surfaces 32 of the arms 30 fact each other so that each arm 30 bows downwardly and outwardly from the receptacle member 20. The bottom ends of the arms 30 are directly below the top ends of the arms 30 so that the arms 30 partially encircle the space below the receptacle member 20, as illustrated in FIG. 3.

The arms 30 are sized to partially encircle a space slightly smaller than an average person's thigh. This allows the arms 30 to be used to attach the receptacle member 20 to a person's thigh by spreading the arms 30 apart, placing the arms 30 around a person's thigh, and allowing the arms 30 to flex back towards their original position, thereby clamping against the person's thigh to hold the receptacle member 20 in place. As seen in FIG. 1, this method of attaching the receptacle member 20 to a person's thigh makes the beverage container holder 10 useful when the person is seated.

Figure 4:
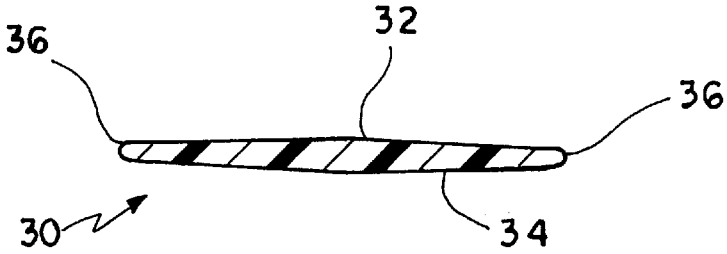
FIG. 4 is a cross-sectional view of the body-attaching member of the present invention taken along lines 4—4 of FIG. 2.

The cross section of each arm 30 is rounded as shown in FIG. 4. The distance between the inner surface 32 and the outer surface 34 of each arm 30 decreases from the middle of the cross section toward the side edge 36 of each arm 30. The side edge 36 of each arm 30 is rounded so that there are no sharp edges on the arms 30. The rounded cross sections of the arms 30 allow them to clamp against a person's thigh with a minimum of discomfort.

In alternate embodiments, structure is provided for the bottom ends of the arms 30 to be attached to each other, to provide a more stable means of attaching the receptacle member 20 to a person's thigh. Such structure may include, but are not limited to, hook and loop fasteners, buckles, snaps, male and female interlocking slots and the like.

It is to be understood that the beverage container holder 10 of the present invention is not limited to the embodiments described above, but encompass any and all embodiments within the scope of the following claims.

I claim:

1. A beverage container holder for supporting a beverage container on a person's thigh, comprising:

a receptacle member having a planar bottom and an integral sidewall, said planar bottom including a circular periphery and an exterior side, said integral sidewall extending upwardly from the periphery of said planar bottom, said sidewall having a top edge, said receptacle member forming a generally cylindrical shell having an open top, said receptacle member including a first slot and a second slot formed in said sidewall of said receptacle member on opposite sides thereof, said first slot and said second slot being aligned vertically and extending from said top edge of said sidewall to a predetermined distance from said planar bottom of said receptacle member, each said first slot and said second slot being configured for receiving a handle of the beverage container, said first slot and said second slot decreasing the rigidity of said receptacle member so that said top edge of said sidewall may flex outwardly to receive the beverage container; and a first arm and a second arm formed of a material having elastic memory, each said arm having side edges, inner and outer surfaces a proximal end and a distal end, each said proximal end attached to said exterior side of said planar bottom of said receptacle member, said first arm and said second arm forming arcuate bands extending outwardly and downwardly from said planar bottom of said receptacle member in spaced relation on opposite sides thereof, the thicknesses of each of said first arm and said second arm tapers slightly from their longitudinal centers to said side edges; said first arm and said second arm adapted to be clamped around the person's thigh to support said receptacle member thereon.

2. The beverage container holder according to claim 1, wherein:

said side edges and said distal end of said first arm and said second arm are rounded.

3. A beverage container holder formed of a single piece of material having elastic memory for attachment to a person's thigh, the holder comprising:

a receptacle member having a planar bottom and an integral sidewall, said planar bottom including a circular periphery and an exterior side, said integral sidewall extending upwardly from the periphery of said planar bottom, said sidewall having a top edge and said receptacle member forming a generally cylindrical shell having an open top, comprising:

a first slot and a second slot formed in said sidewall of said receptacle member on opposite sides thereof, said first slot and said second slot being aligned vertically and extending from said top edge of said sidewall to a predetermined distance from said planar bottom of said receptacle member, said first slot and said second slot being configured to receive a handle of the beverage container, said first slot and said second slot decreasing the rigidity of said receptacle member so that said top edge of said sidewall flexes outwardly to receive the beverage container;

a first arm and a second arm, each said arm having thickness, a proximal end, a distal end, an inner surface, an outer surface and opposing side edges, each said proximal end attached to said exterior side of said planar bottom of said receptacle member, wherein:

said first arm and said second arm form arcuate bands extending outwardly and downwardly from said planar bottom of said receptacle member in spaced relation on opposite sides thereof;

said inner surface of each said first arm and said second arm are concave and face each other;

the thickness of each said first arm and said second arm tapers slightly from their longitudinal centers to said side edges; and said first arm and said second arm being adapted to be placed around the person's thigh to support said receptacle member thereon; and said side edges and said distal end of said first arm and said second arm being rounded so that said first arm and said second arm lack sharp edges.

* * * * *